US005178214A

United States Patent [19]

Bode

[11] Patent Number: 5,178,214

[45] Date of Patent: Jan. 12, 1993

[54] RESTRICTION SUB WITH DEFORMABLE PLASTIC SLEEVE

[76] Inventor: Robert E. Bode, 10802 Green Creek Dr., #209, Houston, Tex. 77070

[21] Appl. No: 848,160

[22] Filed: Mar. 9, 1992

[51] Int. Cl.[5] ..... E21B 33/05; E21B 23/10; E21B 47/09

[52] U.S. Cl. ..... 166/70; 166/154; 166/242

[58] Field of Search ..... 166/70, 153, 202, 215, 166/255, 270, 285, 319

[56] References Cited

U.S. PATENT DOCUMENTS

| | | | |
|---|---|---|---|
| 4,067,386 | 1/1978 | Weise | 166/255 X |
| 4,427,065 | 1/1984 | Watson | 166/70 X |
| 4,674,573 | 6/1987 | Bode | 166/291 |
| 4,756,365 | 7/1988 | Schneider | 166/153 |
| 4,907,649 | 3/1990 | Bode | 166/70 |
| 5,092,402 | 3/1992 | Perricone et al. | 166/255 X |

*Primary Examiner*—Ramon S. Britts

*Assistant Examiner*—Frank S. Tsay

*Attorney, Agent, or Firm*—Dodge, Bush, Moseley & Riddle

[57] ABSTRACT

In accordance with an illustrative embodiment of the present invention, a restriction sub apparatus for use during well cementing operations includes a tubular body having an internal annular recess, and a plastic restriction sleeve mounted in the recess, such sleeve having an inner diameter which is less than the inner diameter of the body so that when a drive plate on a cement displacement plug encounters the inner portion of the sleeve during downward movement, such inner portion is progressively deformed and bulged inward until the bulge dissipates into a recessed region near the bottom end of the sleeve. The resistance afforded by the plastic sleeve to downward movement of the plug provides a positive pressure surge indication at the surface that the plug is located at a particular depth in the casing.

7 Claims, 1 Drawing Sheet

FIG. 1
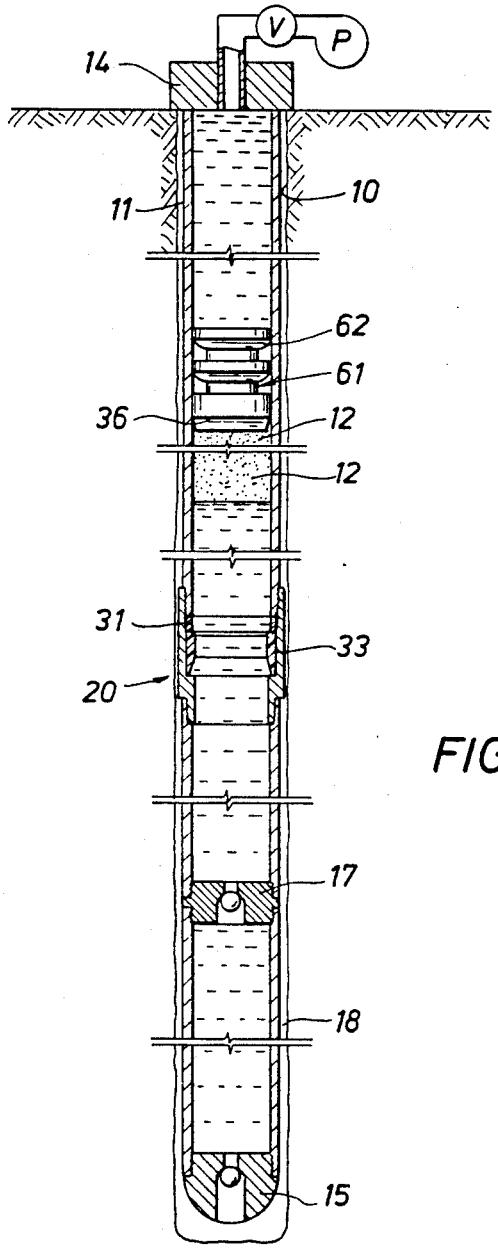
FIG. 2
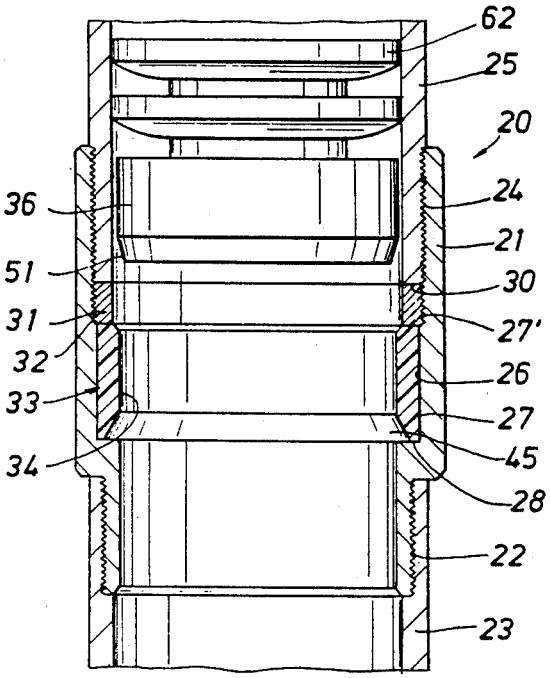
FIG. 3
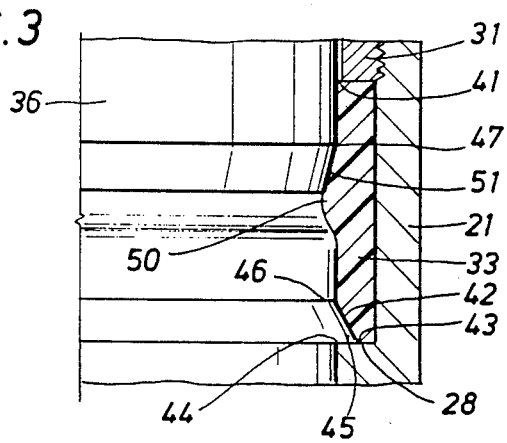
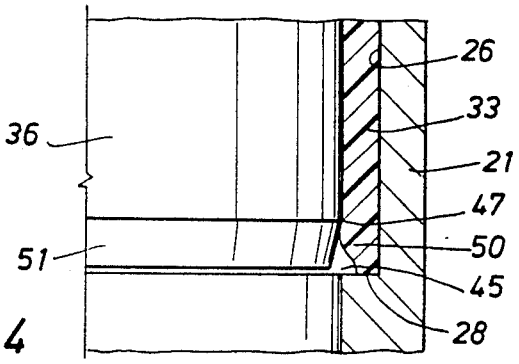
FIG. 4

RESTRICTION SUB WITH DEFORMABLE PLASTIC SLEEVE

FIELD OF THE INVENTION

This invention relates generally to a cement plug monitoring system, and particularly to a new and improved restriction sub that includes a plastic sleeve which impedes the progress of a cement displacement plug down a well casing in a manner that provides a positive surface indication of when the top of a cement column that is being displaced into a casing reaches a predetermined distance from the bottom of the casing.

BACKGROUND OF THE INVENTION

Cement plugs are used in connection with cementing operations in a well for a variety of purposes, for example to provide interfaces between the upper and/or lower ends of a cement slurry column and the mud or displacement fluids that precede or follow it in the casing. When a predetermined volume of cement slurry has been displaced down into the casing, a plug can be used in a manner such that it separates the top of the column from the following displacement fluid. After substantially all of the cement has been pumped out of the casing and into the annulus between the casing and the well bore wall, a surface indication is needed so that pumping operations can be terminated at a point where most of the cement has been displaced into the annulus. Otherwise there is a risk of overdisplacement with attendant difficulties.

A high degree of skill, and occasional guesswork, is required during a cementing operation of the type described to determine when the plug has reached a certain downhole location in the casing. Various devices have been used, such as a simple casing nipple with an internal rubber sleeve that provides a reduced diameter in the bore, in an effort to create an observable pump pressure surge at the surface which indicates that the plug is passing through the bore of the nipple. However, this type of device has not, in the main, provided a reliable surface indication. One or more improvements over such devices are disclosed and claimed in my U.S. Pat. No. 4,907,649 issued Mar. 13, 1990, and in my U.S. application Ser. No. 678,007 filed Apr. 1, 1991. Although the inventions disclosed and claimed therein represent distinct advances in the art, there remains a continuing need for improvements which will provide a simple and reliable restriction sub that will create a distinctive, positive surface indication of the point in time when a displacement plug has reached a certain distance above the bottom of the casing.

A general object of the present invention is to provide a new and improved restriction sub apparatus which includes a uniquely arranged plastic sleeve member which impedes the passage of a cement displacement plug therethough in a manner such that a positive surface indication, as discussed above, is given.

SUMMARY OF THE INVENTION

This and other objects are attained in accordance with the concepts of the present invention through the provision of a restriction sub apparatus comprising a tubular body having an internal annular recess formed therein, and a restriction means mounted in the recess in the form of a plastic sleeve which has a relatively low tensile strength and a relatively high temperature rating. The inner diameter of a mid-portion of the plastic sleeve is sized in a manner such that when a displacement plug fitted with a drive plate on its lower end encounters the plastic sleeve member, the inner region is progressively deformed as the drive plate is forced therethrough. The resistance afforded by the sleeve member to such deformation produces a temporary but distinct pump pressure increases or surge at the surface which signals that the plug, and thus the top of the cement column, is in fact located at the particular depth or location in the casing where the restriction sub has been stationed, which usually is a particular distance above the bottom of the casing string. Then the pumping procedures then can be altered as necessary to complete the cementing operation without overdisplacement. The present invention is relatively simplified in construction, and highly reliable in operation.

BRIEF DESCRIPTION OF THE DRAWINGS

The present invention has other objects, features and advantages that will become more clearly apparent in connection with the following detailed description of a preferred embodiment, taken in conjunction with the appended drawings in which:

FIG. 1 is a schematic view showing a well cementing operation where a cement plug and a restriction sub are being used in the casing.

FIG. 2 is an enlarged cross-sectional view of a restriction sub that is constructed in accordance with the present invention; and FIGS. 3 and 4 are further enlarged fragmentary views showing the deformation of the plastic restriction sleeve as the drive plate of a displacement plug is forced downward therethrough in response to a pressure differential.

DETAILED DESCRIPTION OF A PREFERRED EMBODIMENT

Referring initially to FIG. 1, a well bore 10 that is lined with a casing 11 is shown with a column of cement slurry 12 being pumped downward therein. The casing 11 usually is suspended at the top of the well at a wellhead 14, and various pumps, valves, storage tanks and mixers are used in the cementing process. When the bottom end of the column 12 reaches a float shoe 15, further pumping causes the cement to be displaced into the annulus 18 between the casing 11 and the wall of the well bore 10 where it flows upward therein. A float collar 17 can be located a suitable distance, for example about 80 feet, above the float shoe 15. A restriction sub 20 that is constructed in accordance with the present invention is connected in the casing string 11 a selected distance, for example 150–200 feet, above the float collar 17. Thus the sub 20 is located at a known distance above the bottom of the casing 11.

As shown in FIG. 2, the restriction sub 20 includes a tubular sub 21 having external threads 22 that connect to the casing portion 23 at the lower end thereof, and internal threads 24 that connect to the casing portion 25 at the upper end thereof. An enlongated, internal annular recess 26 is formed in the sub 20, and includes a lower smooth bore section 27 and an upper threaded section 27'. The lower section 27 has an upwardly facing shoulder 28 at its lower end, which opposes the lower end face 30 of the casing portion 25. A metal retainer ring 31 is threaded to the section 27' at 32. A plastic restriction sleeve 33 having an inner bore 34 is mounted inside the bore section 27 between the shoulder 28 and the lower face of the retainer ring 31. The retainer ring 31 has a somewhat lesser internal bore size than the inner diameters of casing portions 23 and 25, and the bore 34 of the sleeve 33 has a somewhat lesser diameter than the corresponding dimensions of the casing portions 25 and 23. The drive plate 36 on the lower end of the cement plug assembly 61 has an outer diameter that is only slightly less than the i.d. of the casing portions 25 and 23. Thus the bore 34 of the plastic sleeve 33 is sized such that the inner region of the sleeve must undergo deformation as the drive plate 36 is pumped through it under pressure.

As shown in enlarged detail in FIG. 3, the restriction sleeve 33 has an upper inner surface 41 that is a chamber which inclines downward and inward, and a lower inner surface 42 of the sleeve inclines downward and outward. The lower edge 43 of the surface 42 preferably is located outside of the inner edge 44 of the shoulder 28 by a small distance. The triangularly shaped, generally annular region 45 inside the dotted line 46 provides a recess into which extrusion is relieved as the drive plate 36 reaches the upper end of the surface 42. Initial engagement of the drive plate 36 with the upper inclined surface 41 causes an inner region of the sleeve 33 to bulge at 50 as the outer inclined surface 51 of the drive plate 36 advances downward. The bulge 50 then is pushed downward ahead of the upper edge 47 of the surface 51 until the bulge can dissipate by extrusion into the region 45 as shown in FIG. 4. The sleeve 33 preferably is made of a plastic material such as teflon having a relatively low tensile strength but a relatively high temperature rating in the neighborhood of 650° F. The yield strength for a teflon suitable for this application is about 6,000 psi. The drive plate 36 of the cement plug 40 preferably is made of a plastic material such as nylon having a much higher yield strength in the order of about 16,000 psi.

OPERATION

In operation, the casing 11 is run into the well with the float shoe 15 attached to the lower end thereof, and with the float collar 17 located a known distance above the float shoe. As mentioned above, the restriction sub 20 typically is connected in the casing string 11 about 150–200 ft. above the float collar 17. Generally speaking, the restriction sub 20 is located one or two joints of casing above the planned final depth of the top end of the cement column 12 in the casing 11.

A conditioning fluid can be pumped into the casing 11 to clean up and condition the well before the cementing process is begun. If desired, a bottom cement plug (not shown) is run ahead of the cement column 12 to provide an interface that prevents any substantial mixing of mud and/or the conditioning fluid with the cement slurry at the lower end of the column. After a selected number of barrels of cement have been displaced into the casing 11, the top plug 61 is launched or otherwise positioned in a manner such that it is located at the top of the column 12. The plug 61 also provides a separation between the displacement fluid and/or mud and the cement at the upper end of the column. As the displacement plug, or plugs, and the cement column 12 travel downward in the casing 11, the upwardly facing elastomer cups 62 and the drive plate 36 of the top plug 61 tend to wipe the interior of the casing 11 clean, leaving substantially no cement on the inner walls thereof.

Where a lower plug is used, it will pass through the restriction sub 20 first and then be pumped on down until it lands on the top of the float collar 17. At this location, a disk in the plug will rupture to allow cement to flow through its center. When the top plug 61 reaches the restriction sub 20, the outer inclined edge surface 51 of the drive plate 36 engages the chamfer 41 at the upper end of the plastic sleeve member 33 and then is forced into the bore 34 of the plastic sleeve 33 by a pressure differential. Since the outer diameter of the drive plate 36 is slightly larger than the bore 34 of the sleeve 33, an inner portion of the sleeve is progressively deformed so that the bulge 50 appears just ahead of the plate, as shown in FIG. 3, and travels downward in front of it. When the bulge 50 reaches the enlarged region 45 at the lower end portion of the sleeve 33, as shown in FIG. 3, it melds into this region to relieve some of the stress produced by deformation. If the recessed area 45 were not present, an inner portion at the lower end of the sleeve 33, having a radial thickness approximately equal to the radial thickness of the bulge 50 in FIG. 3, would be pinched off against the shoulder 28 and become an article of debris in the well bore. The plastic material of which the sleeve member 33 is made has a shape memory so that over a period of time it will recover its original shape as shown in FIG. 2.

The overall resistance afforded by the inner portion of the plastic restriction sleeve 33 to downward passage of the drive plate 36 of the displacement plug 61 therethrough generates a surge in pumping pressure at the surface which is easily observed on the gauges. When this occurs, the top of the cement column 12 will be just below, or at, the restriction sub 20, and at a known distance from the float shoe 15. Such positive surface indication gives the precise downhole position of the plug 61, and also enables the overall efficiency of the pumping system to be evaluated as disclosed and claimed in may U.S. application Ser. No. 678,007. Of course more than one restriction sub 20 can be used in the casing string 11 to provide additional indications of the downhole location of the displacement plug 61.

It now will be recognized that a new and improved plug monitor assembly has been disclosed that is highly useful in cementing operations. Since certain changes or modifications may be made in the disclosed embodiment without departing from the inventive concepts involved, it is the aim of the following claims to cover all such changes and modifications that fall within the true spirit and scope of the present invention.

What is claimed is:

1. A restriction sub apparatus for use in a well casing to provide a surface indication of the downhole position of a cement displacement plug, comprising; a tubular body having means at its ends for connecting said body in the casing, said body having an internal bore and an internal annular recess formed therein; and a plastic sleeve member mounted in said recess, said sleeve member having a mid-portion with an inner diameter that is less than the inner diameter of said bore, and a lower portion that provides annular recess means to provide space for extrusion of an inner portion of said sleeve member as a drive plate passes downward therepast.

2. The apparatus of claim 1 wherein said internal annular recess has an upper portion, and further including means in said upper portion engaging the upper end of said sleeve member for preventing upward extrusion when a drive plate first encounters said sleeve member.

3. The apparatus of claim 2 wherein said preventing means is a metal ring member releasably connected to said tubular body.

4. The apparatus of claim 3 wherein said ring member has a greater internal diameter than said sleeve member, and wherein the upper end of said sleeve member has a downward and inwardly inclined chamfer which provides a surface that leads from said greater diameter of said ring member to said inner diameter of said mid-portion.

5. The apparatus of claim 1 wherein said annular recess means is defined in part by a downward and outwardly inclined inner surface on said lower portion.

6. The apparatus of claim 1 wherein the plastic material of said sleeve member has a relatively low tensile strength and a relatively high temperature rating.

7. The apparatus of claim 6 wherein said plastic material is a teflon having a yield strength of about 6,000 psi and a temperature rating of about 650° F.

* * * * *